US007081804B2

(12) United States Patent
Kitagawa

(10) Patent No.: US 7,081,804 B2
(45) Date of Patent: Jul. 25, 2006

(54) CHIP COIL

(75) Inventor: Masaki Kitagawa, Ina (JP)

(73) Assignee: Koa Kabushiki Kaisha, Ina (JP)

( * ) Notice: Subject to any disclaimer, the term of this patent is extended or adjusted under 35 U.S.C. 154(b) by 0 days.

(21) Appl. No.: 11/010,417

(22) Filed: Dec. 14, 2004

(65) Prior Publication Data

US 2005/0174205 A1 Aug. 11, 2005

(30) Foreign Application Priority Data

Feb. 5, 2004 (JP) ..... 2004-029712

(51) Int. Cl.
*H01F 5/00* (2006.01)

(52) U.S. Cl. ..... 336/200

(58) Field of Classification Search ..... 336/83, 336/200, 65, 192
See application file for complete search history.

(56) References Cited

U.S. PATENT DOCUMENTS 4,314,221 A * 2/1982 Satou et al. ..... 336/83
4,842,352 A * 6/1989 Sasaki et al. ..... 336/83
6,055,721 A * 5/2000 Mamada et al. ..... 29/605
6,680,664 B1 * 1/2004 Fan ..... 336/83

FOREIGN PATENT DOCUMENTS

JP 9-219318 A 8/1997

* cited by examiner

*Primary Examiner*—Tuyen T Nguyen
(74) *Attorney, Agent, or Firm*—Smith Patent Office

(57) ABSTRACT

Electrodes of a chip coil are provided at no magnetic flux concentrated positions of a core of the chip coil. In other words, the chip coil has a configuration where: lead frames are provided at the center of the length of both brims of the core; conductive parts and the ends of a conductive wire are connected to internal electrodes, which are made of thin metal films and provided on both brims, respectively; and external electrodes are extended so as to protrude from the sides of a core drum. This reduces magnetic loss and prevents deterioration of characteristics and the Q value due to the electrodes.

6 Claims, 6 Drawing Sheets

CHIP COIL

BACKGROUND OF THE INVENTION

1. Field of the Invention

The present invention relates to a chip coil, which is used for, for example, compact communication equipment or electronic devices.

2. Description of the Related Art

As sizes and weights of electronic devices are reduced, requests for reduction in size (integration onto a chip) of electronic components increase. As disclosed in Japanese Patent Application Laid-Open No. 9-219318, for example, a chip inductor, which is a chip electronic component, forms a coil made by winding a conductive wire around a square pole winding drum, which has flange-shaped brims protruding from both edges. And, formed on part of the end faces of those brims are plated electrodes.

FIG. 8 shows an example of a configuration of a conventional chip inductor. A chip inductor 60 shown in FIG. 8 has electrodes 65 and 67, which are formed on the entire surface of the brims 62 and 64 of a core, and is mounted upon a printed circuit board so that the direction of the length thereof can be the same as the running direction of patterns 61 and 63, which are signal lines on that printed circuit board.

The results from carrying out an electromagnetic field simulation for the above-described conventional chip inductor show that, as shown in FIG. 9, concentration of magnetic fluxes has occurred at the portions indicated by symbols (O) in the brims 62 and 64, which are components of the core. In other words, as is seen from FIGS. 8 and 9, the conventional chip inductor has a configuration where electrodes 65 and 67 are formed at the magnetic flux concentrated portions of the core.

There are problems with the conventional inductor in which the above-described configuration causes increase in magnetic loss and decrease in the Q value.

The present invention has been developed in view of the above-described problems, and aims to provide a chip coil, which reduces magnetic loss and prevents decrease in sensitivity characteristics and the Q value and is suitable for use as an antenna for wireless communications by mounting on various wireless communication equipment (e.g., radio frequency identification (RFID)).

SUMMARY OF THE INVENTION

The present invention has a configuration to achieve the above objectives and solve the above-described problems. In other words, a chip coil according to the present invention is made up of a core including a drum and brims provided on both ends of that drum; a coil conductor formed on the drum; and external electrodes that are electrically connected to the coil conductor; wherein the external electrodes are arranged between the brims.

The chip coil further includes a conductive part extended from each external electrode, wherein the conductive part is connected to one end of the coil conductor. In addition, the width of the conductive part is smaller than that of the drum.

The conductive part is arranged so as to fall within the width of the drum of the core. In addition, internal electrodes are formed on the brims, and the coil conductor is connected to the internal electrodes.

Each of the widths of the internal electrodes is smaller than that of the drum. In addition, the internal electrodes are metal coated films formed on an insulator substrate, which is fixed to the brims. Furthermore, the tips of the external electrodes are not fixed.

The internal electrodes have a first metal layer and a second metal layer formed separately on the first metal layer, and the end of the coil conductor is arranged between separately-formed second metal layer and is sandwiched in between the conductive part and the first metal layer.

The present invention allows reduction in magnetic loss of the coil and prevents decrease in sensitivity and the Q value due to the electrodes of the coil.

DETAILED DESCRIPTION OF THE INVENTION

Figure 1:
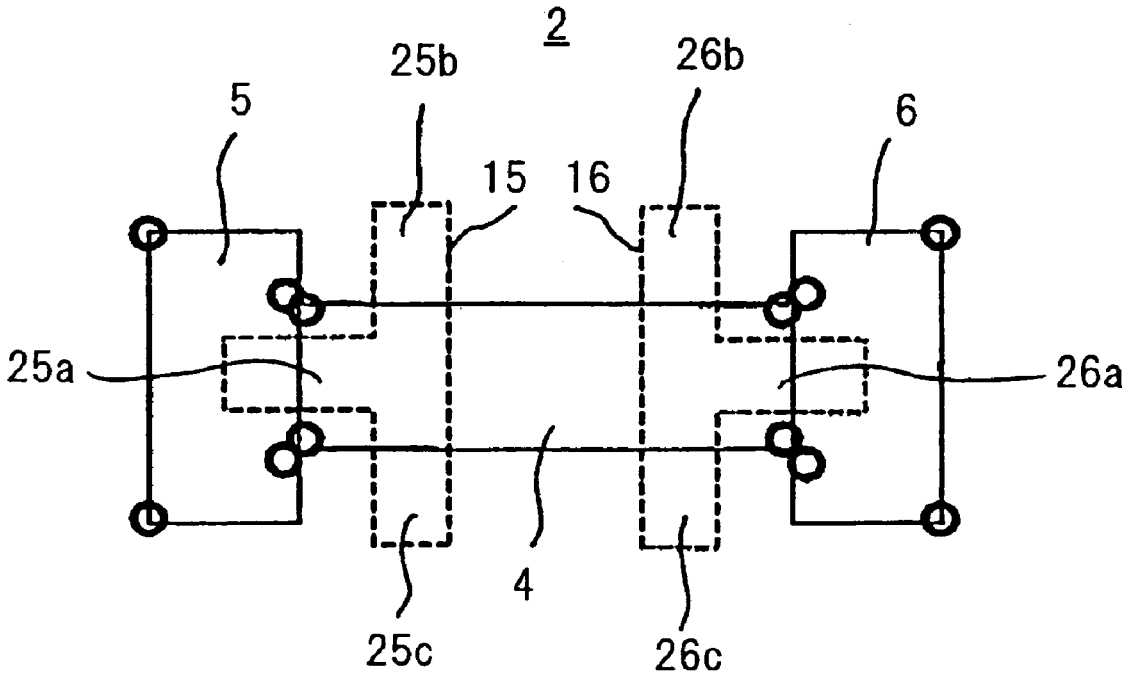
FIG. 1 is a diagram describing an arrangement of electrodes of a chip coil according to an embodiment of the present invention.

An embodiment of the present invention is described forthwith in detail while referencing the attached drawings. FIG. 1 is a diagram describing an arrangement of electrodes of a chip coil according to the embodiment. Magnetic flux concentrated portions of the chip coil have been found through the above-described electromagnetic field simulation. Magnetic flux concentrated portions are indicated by symbols (O) in FIG. 1. Major concentrated portions are four corners of both ends of a core 2, which is made up of a core drum 4 and brims 5 and 6, and four corners of both ends of the core drum 4.

According to the chip coil of the present embodiment, T-shaped lead frames 15 and 16 are used as electrodes and arranged at portions other than the magnetic flux concentrated portions so as to prevent those electrodes from overlapping with those magnetic flux concentrated portions, as shown in FIG. 1. The lead frames 15 and 16 are T-shaped and made up of strip-shaped portions having external electrodes 25*b*, 25*c*, 26*b*, and 26*c* on respective both ends, and conductive parts 25*a* and 26*a*, which extend perpendicular to those strip-shaped portions almost at the center thereof.

The conductive parts 25*a* and 26*a* are fixed to the brims 5 and 6, respectively, using the method described below, and extend toward the center of the core 2. On the other hand, the external electrodes 25*b*, 25*c*, 26*b*, and 26*c* are extended so as to protrude from the sides of the core drum 4. As is apparent from FIG. 1, each of the widths of the conductive parts 25*a* and 26*a* is smaller than that of the core drum 4. By arranging them within the width of the core drum 4, the lead frames 15 and 16 cannot overlap with the magnetic flux concentrated portions when the core 2 is viewed from above.

A chip coil manufacturing process and a configuration of a chip coil according to the embodiment are described forthwith in detail. FIGS. 2A through 2F show the steps of manufacturing the chip coil according to the embodiment. In the step shown in FIG. 2A, boards 21 and 22 are fixed to the core 2 of the chip coil. Those boards 21 and 22 are ceramic insulator substrates on which thin metal films made from copper (Cu) are formed configuring internal electrodes (or internal conductors) 23 and 24.

Concave portions 31 and 32, having sizes corresponding to those of the boards 21 and 22, respectively, are provided on top of the brims 5 and 6 at the ends of the core drum 4. The boards 21 and 22 are fixed to those concave portions 31 and 32, respectively, using an adhesive.

Figure 9:
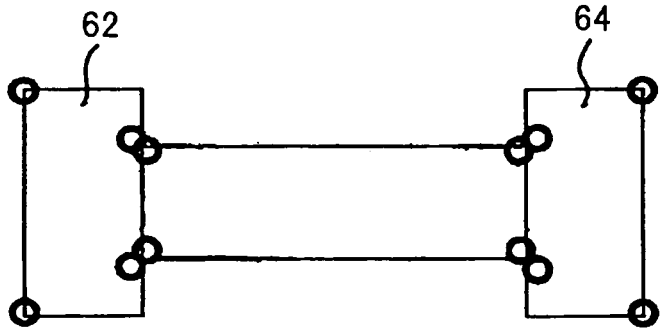
FIG. 9 shows magnetic flux concentrated portions of the chip inductor as a result of an electromagnetic field simulation.

Note that positions on top of the brims 5 and 6 for fixing the internal electrodes 23 and 24 may be positions other than the magnetic flux concentrated regions in FIG. 1 or FIG. 9, for example, and although omitted from the drawing, they may be at the respective centers on top of the brims 5 and 6. When viewing the chip coil from above, each of the widths of the internal electrodes (thin metal films) 23 and 24 is smaller than that of the core drum 4, and the positions of those internal electrodes are determined to fall within the width of the core drum 4 of the core 2 (see FIG. 1). In addition, the reason why thin metal films are not directly formed on the brims 5 and 6 is to prevent the thin metal film from peeling off the core 2 due to difference in the thermal contraction ratio between the thin metal film and the core 2, which is made of a magnetic material with high permeability, such as ferrite. The internal electrodes 23 and 24 are formed in the core 2 to facilitate mass production of the chip coil by providing portions that allow fixation of the ends of a conductive wire, which becomes a coil conductor 11, in the core 2.

Figure 2A:
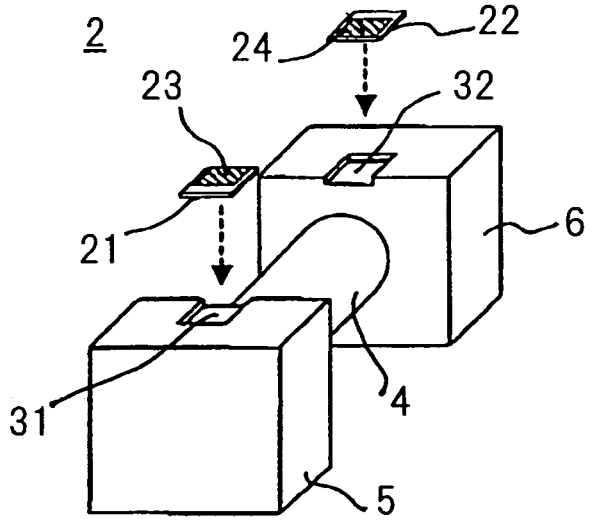
FIGS. 2A through 2F show a chip coil manufacturing process according to the embodiment.
Figure 2B:
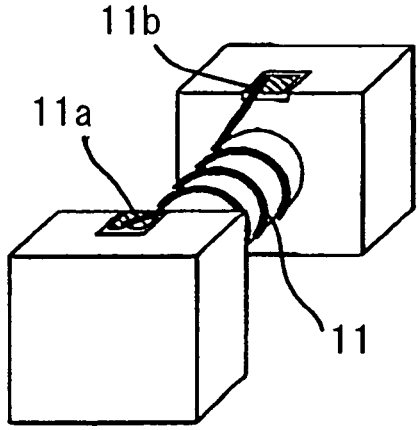

In the step shown in FIG. 2B, the coil conductor 11 is formed by winding a conductive wire around the core drum 4 of the core 2 a prescribed number of times so that the inductance of the chip coil can reach a desired value. The ends 11*a* and 11*b* of that conductive wire are connected to the internal electrodes 23 and 24, respectively. A polyurethane-coated copper wire or a polyimide coated wire is used as the conductive wire. In addition, connection of the ends 11*a* and 11*b* to the internal electrodes 23 and 24 is carried out using metal diffusion, conductive adhesives, or welding.

Note that the conductive wire 11 may be formed by stacking green sheets, each having a coil pattern, or forming a thick or a thin metal coated film on the surface of the core drum 4.

Figure 2C:
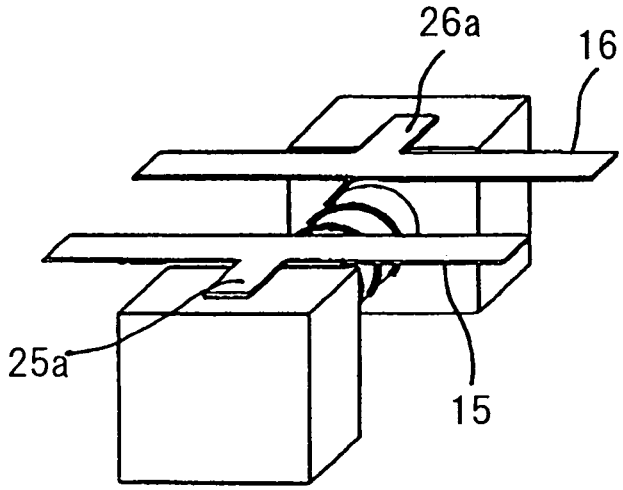

In the next step, lead frames 15 and 16 are fixed. As shown in FIG. 2C, the conductive part 25*a* of the T-shaped lead frame 15 is connected and fixed to the end 11*a* of the coil conductor 11 on the internal electrode 23. On the other hand, the conductive part 26*a* of the lead frame 16 is connected and fixed to the end 11*b* of the coil conductor 11 on the internal electrode 24. As described above, each of the widths of the conductive parts 25*a* and 26*a* is smaller than that of the core drum 4. This allows arrangement thereof so that they can fall within the width of the core drum 4.

Plated oxygen-free copper (H or (½)H) is used as the lead frames 15 and 16. In addition, the lead frames 15 and 16 are fixed to the internal electrodes 23 and 24, respectively, using a method of metal diffusion, welding, soldering, or using a conductive adhesive. The internal electrodes 23 and 24 are not limited to a rectangle as shown in the drawing, and may be a circle or an ellipse as long as the lead frames 15 and 16 can be fixed thereto, there is a sufficient area for bonding to the ends 11*a* and 11*b* of the conductive wire described above, and a constant bonding strength can be kept.

Figure 2D:
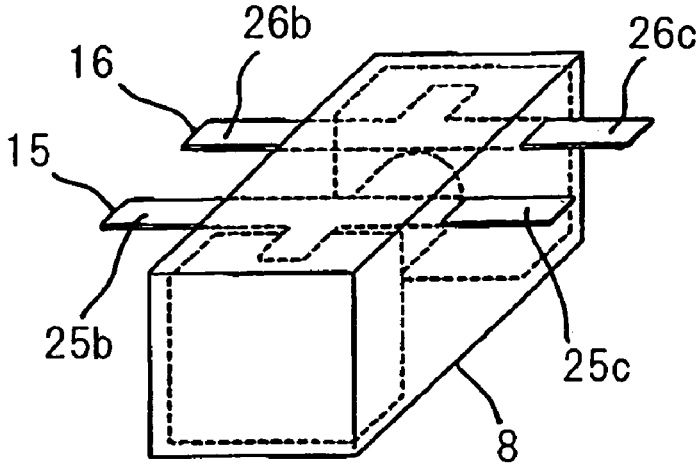

In the step shown in FIG. 2D, the core 2 to which the lead frames 15 and 16 are fixed is entirely coated with resin 8 so that parts of lead frames 15 and 16 can protrude from both ends of the chip coil width, respectively, and that the external electrodes 25*b*, 25*c*, 26*b*, and 26*c* can be formed. For example, rubber elastic silicon resin is used as the resin 8 to seal the entire chip coil. This absorbs stress and shock to the core 2, resulting in improvement of tolerance of mechanical vibrations and humidity. Note that the resin 8 to be used for sealing may be low-stress epoxy resin.

Figure 2E:
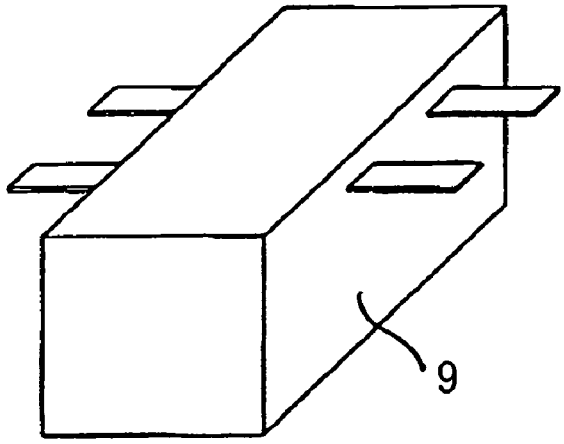

In the next step, an external packaging is formed. In other words, as shown in FIG. 2E, an external packaging 9 is formed by sealing with epoxy resin. In the next step shown in FIG. 2F, the external electrodes 25*b*, 25*c*, 26*b*, and 26*c* of the lead frames 15 and 16 are bent to form electrodes of the chip coil.

Figure 2F:
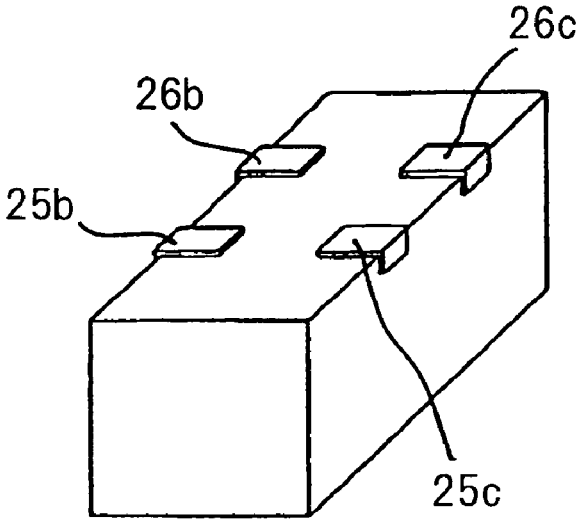
Figure 3:
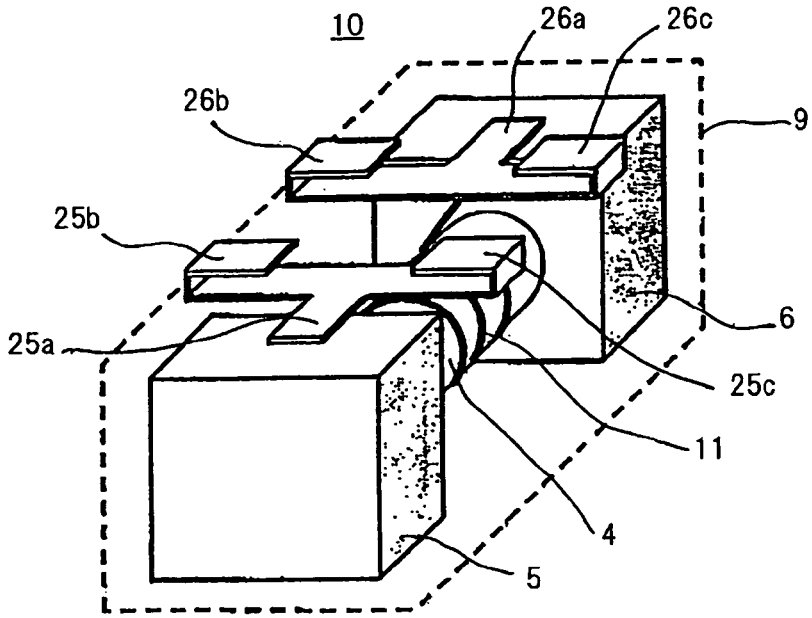
FIG. 3 is a perspective view showing an entire configuration of the chip coil according to the embodiment.
Figure 8:
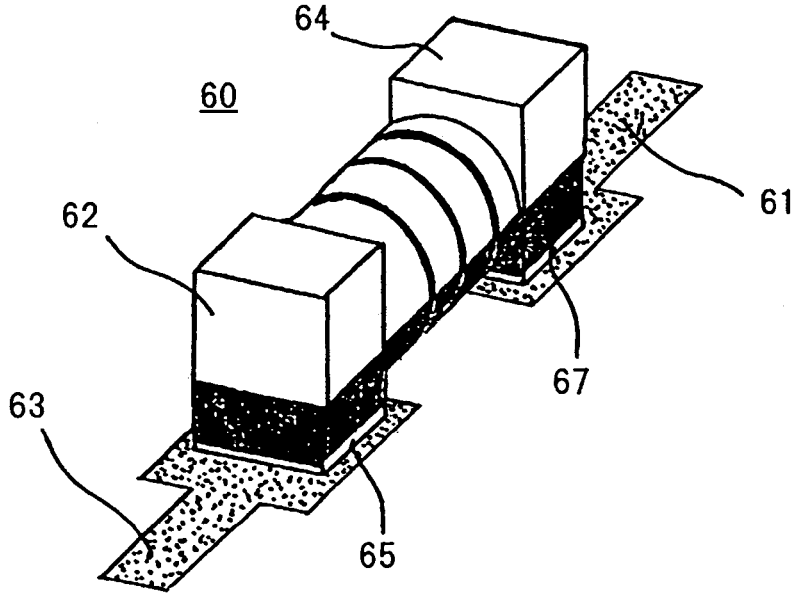
FIG. 8 shows an example of the exterior of the conventional chip inductor.

FIG. 3 is a perspective view showing an entire configuration of the chip coil according to the embodiment. The chip coil manufactured through the steps shown in FIGS. 2A through 2F has an internal configuration shown in FIG. 3. In other words, fixation of the ends 11*a* and 11*b* of the conductive wire, which configures the coil conductor 11, on the internal electrodes 23 and 24, respectively, allows connection of those ends 11*a* and 11*b* to the conductive parts 25*a* and 26*a*, respectively, on top of the brims 5 and 6, which are provided at both ends of the core drum 4. Those conductive parts 25*a* and 26*a* extend toward the center of the length of the core conductor 4, and the external electrodes 25*b*, 25*c*, 26*b*, and 26*c* protrude from the external packaging 9 and bent along the surface of the external packaging 9. In other words, the chip coil according to the embodiment does not have a configuration where the electrodes are formed at both ends of the coil length as with the conventional chip coil shown in FIG. 8, but has a configuration where the positions of the electrodes shift toward the center of the length of the chip coil 10.

In addition, the external electrodes 25*b*, 25*c*, 26*b*, and 26*c* of the chip coil according to the embodiment have a configuration where the portions (bent portions shown in FIG. 2F) protruding from the external packaging 9 are not fixed to the exterior resin, as shown in FIG. 2F and FIG. 3. Therefore, even if the printed circuit board is deflected by external forces after having mounted the chip coil 10 on that board, the external electrodes 25*b*, 25*c*, 26*b*, and 26*c* exhibit flexibility along that deflection. This prevents connections between electrodes and corresponding patterns on the board from breaking (solder crack) due to deflection of the printed circuit board.

As described above, an arrangement of the electrodes of the chip coil at no magnetic flux concentrated positions of the core of the chip coil reduces magnetic loss of the coil, and prevents decrease in sensitivity and the Q value due to the electrodes and the land patterns. In addition, the land patterns on the printed-circuit board on which that chip coil is to be mounted are provided aligned with the electrodes so that the routes of magnetic fluxes of the coil cannot be broken or divided. This reduces magnetic loss and prevents decrease in sensitivity and the Q value due to the land patterns.

Moreover, a configuration of the ends of the external electrodes not fixed to exterior resin of the chip coil prevents break of connection of the patterns on the printed circuit board and the electrodes, and keeps electrical connection while securing a suitable bonding strength therebetween even if the printed circuit board on which the chip coil is mounted deflects.

Figure 4:
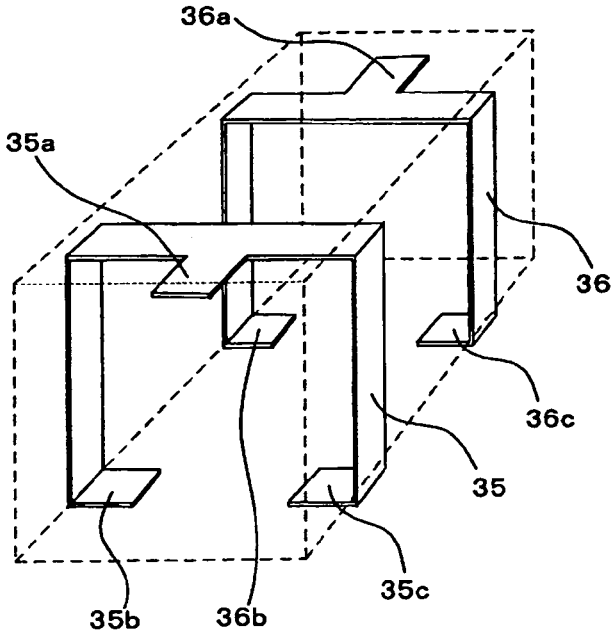
FIG. 4 shows a shape of a lead frame of a chip coil according to a modified example.

Note that the present invention is not limited to the above-described embodiment, and various changes are allowed within the range not deviating from the scope of the invention. Lead frames 35 and 36 may be bent to form the shapes shown in FIG. 4, for example, and provided at magnetic flux non-concentrated positions as with the above-described embodiment. In this case, conductive parts 35*a* and 36*a* of the lead frames 35 and 36 are provided on the internal electrodes (thin metal films) to which the ends of the conductive wire are connected, aligned so that the lead frames 35 and 36 can face each other, and then fixed.

Figure 5:
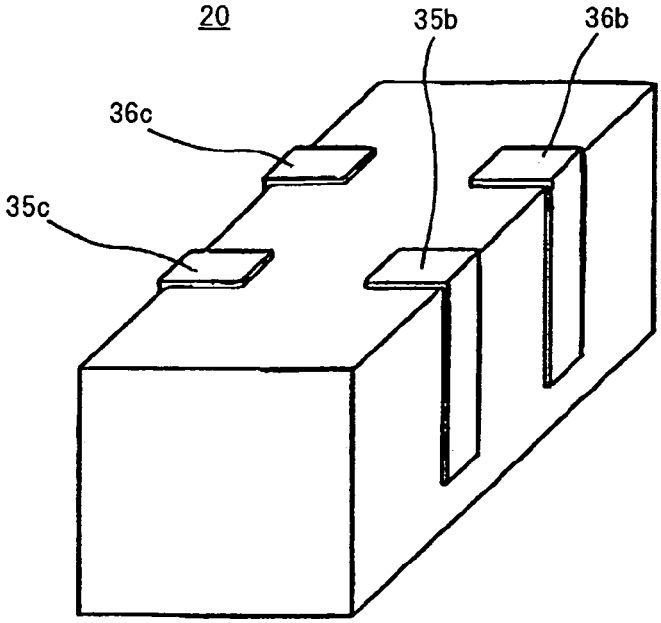
FIG. 5 is a perspective view of the exterior of the chip coil according to the modified example.

FIG. 5 is a perspective view of a chip coil 20 according to this modified example. This chip coil 20 has a configuration where: the lead frames 35 and 36 shown in FIG. 4 partially protrude from both sides of the width of the chip coil 20, forming external electrodes 35*b*, 35*c*, 36*b*, and 36*c*; and resin such as rubber elastic silicon resin is used to seal entirely. In other words, the chip coil 20 shown in FIG. 5 has electrodes which have a configuration where the lead frames 35 and 36 partially protrude from the top of the chip main body, extend to the bottom along the chip sidewalls, and are bent toward the bottom.

The external electrodes 35*b*, 35*c*, 36*b*, and 36*c* of the chip coil 20 are not fixed to the exterior resin on the outside of the chip main body. As a result, flexibility of the external electrodes can prevent break in connection of those electrodes and the patterns on the printed circuit board even if the printed circuit board is deflected by external forces after mounting the chip coil on that board.

Figure 6:
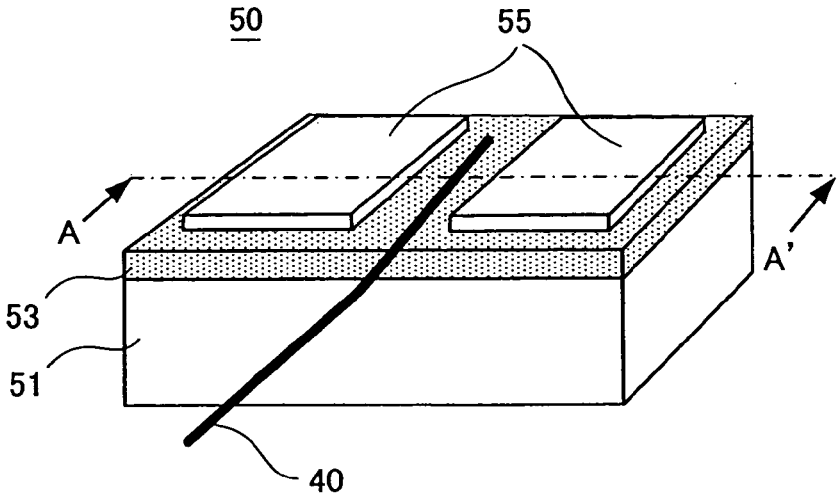
FIG. 6 is a perspective view of a board according to another modified example.

FIG. 6 is a perspective view of a board according to another modified example which is fixed to a core of the chip coil. As shown in FIG. 6, the board 50 is comprised of a ceramic insulator substrate 51 on which two metal layers, that is, a first copper layer 53 and a second copper layer 55 are formed configuring internal electrode. The first copper layer 53 covers entire surface of the substrate 51 while the second copper layer 55 is formed to partially cover the first copper layer 53. These two copper layers 53 and 55 are made by using a sintering processing. Thickness of the first copper layer 53 is, for example, 5 to 40 μm and the second layer 55 has a thickness of 20 to 30 μm.

In this modified example, the second layer 55 has two separate regions on the first copper layer 53. This configuration provides an area between these regions to which the end of a conductive wire 40 is connected using, for example, metal diffusion, conductive adhesives, or welding.

Figure 7:
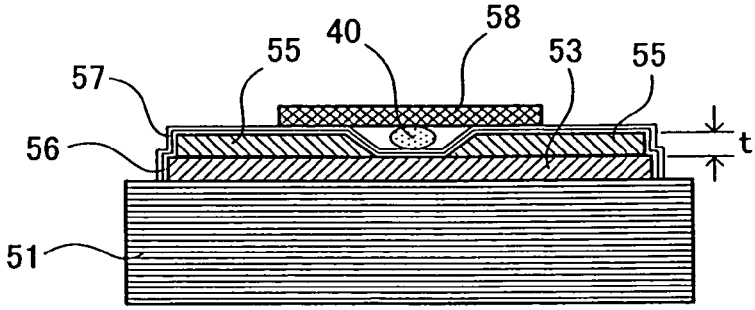
FIG. 7 is a sectional view of the board according to the modified example.

FIG. 7 is a sectional view of the board 50, taken in direction of the arrows A and A in FIG. 6. In this example, two copper layers 53 and 55 are entirely coated with a metal such as nickel (Ni) and tin (Sn) as indicated by reference numerals 56 and 57 respectively in FIG. 7. Conductive part 58 of a lead frame is fixed to the second copper layer 55 as an internal electrode on the board 50 using a method of metal diffusion, welding, soldering, or using a conductive adhesive. Therefore the end of the conductive wire 40 is sandwiched in between the conductive part 58 and the first copper layer 53, which enables the conductive wire 40 to electrically connect to the lead frame.

According to this modified example, the degree of pressing the end of the conductive wire 40 with the conductive part 58 is adjustable by changing the thickness t of the second copper layer 55. As a result of this, it is capable of avoiding break of a conductive wire 40 when welding the conductive part 58 of the lead frame to the second copper layer 55.

While the invention has been described with reference to particular example embodiments, further modifications and improvements which will occur to those skilled in the art, may be made within the purview of the appended claims, without departing from the scope of the invention in its broader aspect.

What is claimed is:

1. A chip coil having a core including a drum and flange-shaped brims provided on both ends of said drum, and a coil conductor formed on said drum, comprising;

lead frames having a prescribed shape to form external electrodes of said chip coil;

internal conductors formed in a portion of said flange-shaped brims;

wherein said external electrodes are electrically connected to said coil conductor through said internal conductors, and wherein said external electrodes and said internal conductors are arranged so as to avoid four outside corners of both ends of said core and four corners of both ends of said drum when viewed in a plan view of said core.

2. The chip coil according to claim 1, wherein said lead frames are T-shaped including a strip-shaped portion with an extended conductive part which is connected to one end of said coil conductor on said internal conductor, so that said lead frames are not overlapping with said corners where concentration of magnetic fluxes generated by said coil conductor occurs.

3. The chip coil according to claim 2, wherein a width of said conductive part is smaller than that of a width of said drum of said core and is arranged so as to fall within the width of said drum, and wherein both ends of said strip-shaped portion include bent portions to form electrodes of the chip coil.

4. The chip coil according to claim 3, wherein said conductive part extends perpendicular to said strip-shaped portion at approximately a center of said strip-shaped portion, and opposite end of said conductive part is fixed to said internal conductor.

5. The chip coil according to claim 1, wherein said coil conductor is formed by winding a conductive wire around said drum a prescribed number of times, and wherein said internal conductors provide portions that allow fixation of the ends of said conductive wire.

6. The chip coil according to claim 5, wherein said internal conductors provide a sufficient area for bonding to the ends of said conductive wire.

* * * * *